US006890144B2

(12) United States Patent
Yu et al.

(10) Patent No.: US 6,890,144 B2
(45) Date of Patent: May 10, 2005

(54) LOW NOISE FUEL PUMP DESIGN

(75) Inventors: DeQuan Yu, Ann Arbor, MI (US); Stephen Thomas Kempfer, Canton, MI (US); Paul Edward Fisher, Dexter, MI (US); Norman Nelson Krieger, Milford, MI (US); David M. Dokas, Ann Arbor, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 184 days.

(21) Appl. No.: 10/256,619

(22) Filed: Sep. 27, 2002

(65) Prior Publication Data

US 2004/0062634 A1 Apr. 1, 2004

(51) Int. Cl.[7] ..... F04D 5/00
(52) U.S. Cl. ..... 415/55.4; 415/119
(58) Field of Search ..... 415/55.1, 55.2, 415/55.4, 55.5, 55.7, 119

(56) References Cited

U.S. PATENT DOCUMENTS

| | | | | |
|---|---|---|---|---|
| 2,217,211 | A | 10/1940 | Brady | |
| 3,804,547 | A | 4/1974 | Hagemann | |
| 3,951,567 | A | 4/1976 | Rohs | |
| 4,253,800 | A | 3/1981 | Segawa et al. | 415/119 |
| 4,478,550 | A | 10/1984 | Watanabe et al. | |
| 4,586,877 | A | 5/1986 | Watanabe et al. | |
| 4,881,871 | A | 11/1989 | Wunderlich | |
| 4,923,365 | A | 5/1990 | Rollwage | 416/203 |
| 5,163,810 | A | 11/1992 | Smith | |
| 5,449,269 | A | 9/1995 | Frank et al. | |
| 5,498,124 | A | 3/1996 | Ito et al. | |
| 5,558,490 | A | 9/1996 | Dobler et al. | |
| 5,716,191 | A | 2/1998 | Ito et al. | |
| 5,772,393 | A | 6/1998 | Nakamura et al. | |
| 5,913,657 | A | 6/1999 | Mollenhauer | |
| 5,975,843 | A | 11/1999 | Ebihara | |
| 6,017,183 | A | 1/2000 | Dobler et al. | |
| 6,082,984 | A | 7/2000 | Matsumoto et al. | |
| 6,132,185 | A | 10/2000 | Wilhelm | |
| 6,135,730 | A | 10/2000 | Yoshioka | |
| 6,152,686 | A | 11/2000 | Neidhard et al. | |
| 2001/0026757 | A1 | 10/2001 | Marx et al. | |
| 2001/0028844 | A1 | 10/2001 | Narisako et al. | |
| 2001/0041132 | A1 | 11/2001 | Marx et al. | |

FOREIGN PATENT DOCUMENTS

| | | | |
|---|---|---|---|
| GB | 2220706 | A | 1/1990 |

*Primary Examiner*—Edward K. Look
*Assistant Examiner*—Dwayne White
(74) *Attorney, Agent, or Firm*—Brinks Hofer Gilson & Lione

(57) ABSTRACT

A regenerative fuel pump comprising a housing, a pump cover having a first flow channel formed therein, a pump body having a second flow channel formed therein whereby the first flow channel and the second flow channel define a pumping chamber, and an impeller mounted between the pump cover and pump body and including a plurality of vanes spaced circumferentially about the impeller and defining a plurality of vane grooves. The vanes are spaced un-evenly in a non-repeating pattern about the impeller. The first and second flow channels each include an inlet end, an outlet end, and a stripper area defined as the area between the inlet end and the outlet end extending from the inlet end away from the flow channel. Each of the stripper areas including a plurality of grooves formed therein adapted to dampen pressure pulsations within the pumping chamber.

23 Claims, 6 Drawing Sheets

LOW NOISE FUEL PUMP DESIGN

TECHNICAL FIELD

The present invention generally relates to an automotive fuel pump for use with an automobile engine.

BACKGROUND

Regenerative fuel pumps with a ring impeller are well known in the industry and are especially used for lower voltage, high pressure applications. However, this type of regenerative fuel pump that has an impeller with a ring extending around the outer diameter exhibits "disadvantageous" characteristics when used in an Electrical Returnless Fuel System (ERFS). When the vehicle is at idle, the fuel pump of an ERFS typically spins at approximately 3,000 to 4,000 revolutions per minute (rpm), while the fuel pump of a traditional system spins at approximately 8,000–9,000 rpm. At the lower rpm rate, the impeller exhibits pressure pulsation noise in the fuel pump.

Therefore, there is a need for a fuel pump that will dampen the pressure pulsation within the fuel pump while maintaining the efficiency advantages of the ring impeller.

DETAILED DESCRIPTION OF THE PREFERRED EMBODIMENTS

The following description of the preferred embodiments of the invention is not intended to limit the scope of the invention to these preferred embodiments, but rather to enable any person skilled in the art to make and use the invention.

Figure 1:
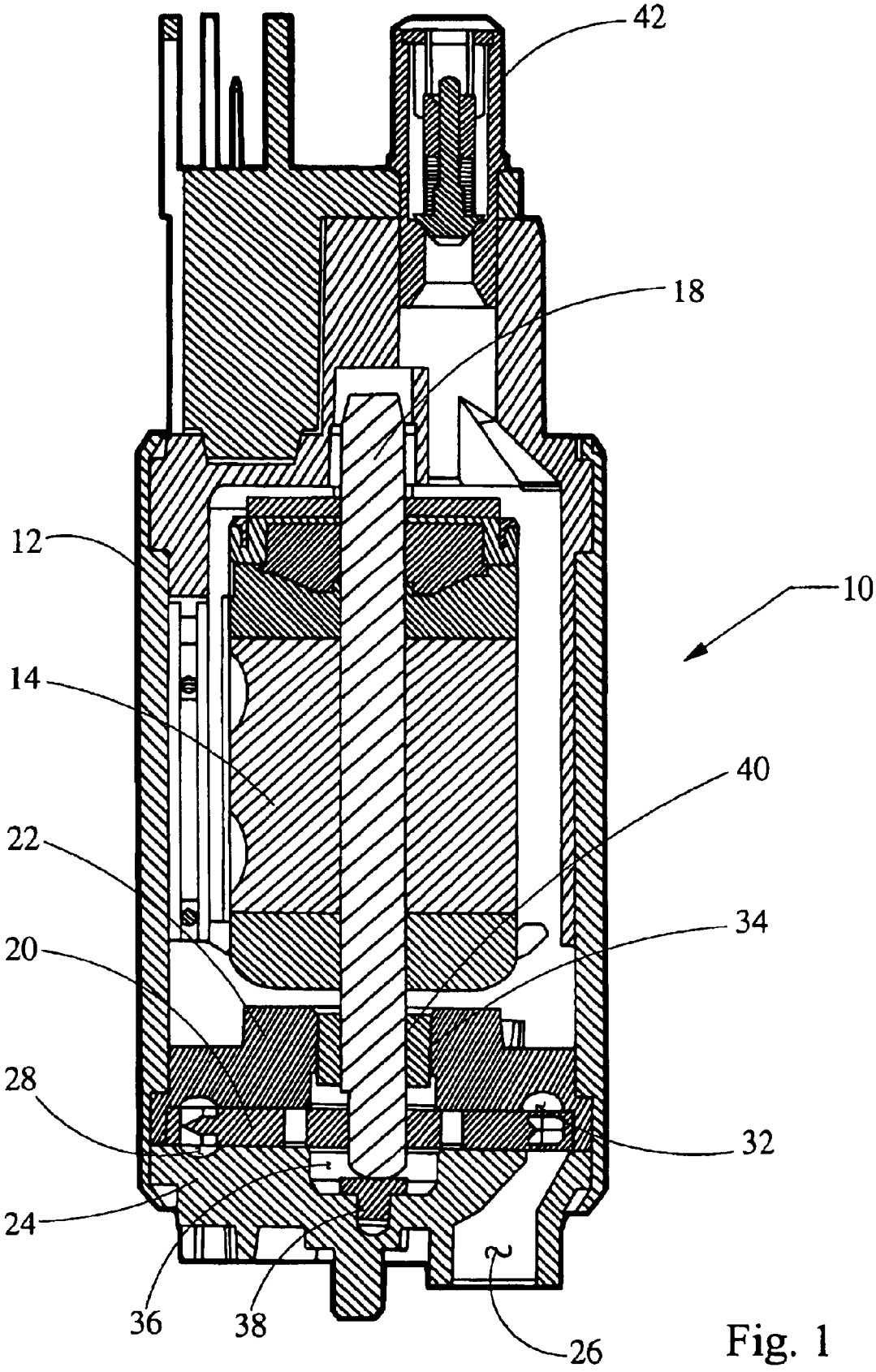
FIG. 1 is a cross sectional view of a fuel pump of the present invention.

Referring to FIG. 1, a fuel pump of the present invention is generally shown at 10. The fuel pump 10 includes a housing 12 and a motor 14 mounted within the housing 12. Preferably, the motor 14 is an electric motor with a shaft 18 extending therefrom. An impeller 20 is fitted onto the shaft 18 and is encased within the pump housing 12 between a pump body 22 and a pump cover 24.

The pump cover 24 is mounted within the housing 12 and has a first side that has a fuel inlet orifice 26 and a second side that defines a sealing surface. The second side further includes a first flow channel 28 formed therein. The fuel inlet orifice 26 extends through the pump cover 24 and is in fluid communication with the first flow channel 28.

The pump body 22 is also mounted within the housing 12, adjacent the pump cover 24. The pump body 22 has a first side that has a fuel outlet orifice 30 and a second side that has a second flow channel 32 formed therein. The first flow channel 28 and the second flow channel 32 define a pumping chamber. The fuel outlet orifice 30 extends through the pump body 22 and is in fluid communication with the second flow channel 32.

The impeller 20 fits onto the shaft 18 such that the impeller 20 is free to move axially along the shaft 18 and rotates with the shaft 18. Therefore, the impeller 20 "floats" between the pump cover 24 and the pump body 22. The fuel pump 10 is of a conventional type which is further described in U.S. Pat. Nos. 6,210,102; 6,296,439; and 6,299,406, which are all commonly assigned to the same assignee as the present application and are hereby incorporated by reference into the present application.

The impeller 20 has a central axis which is coincident with the axis of the shaft 18. The shaft 18 passes through a shaft opening 34 in the pump body 22, through the impeller 20, into a cover recess 36, and abuts a thrust button 38. The shaft 18 is journalled within a bearing 40. The pumping chamber is formed along the periphery of the impeller 20 by the first flow channel 28 of the pump cover 24 and the second flow channel 32 of the pump body 22. Pressurized fuel is discharged through the fuel outlet orifice 30 and cools the motor 14 while passing over the motor 14 to a pump outlet 42 at an end of the pump 10 which is axially opposite the fuel inlet orifice 26.

Figure 2:
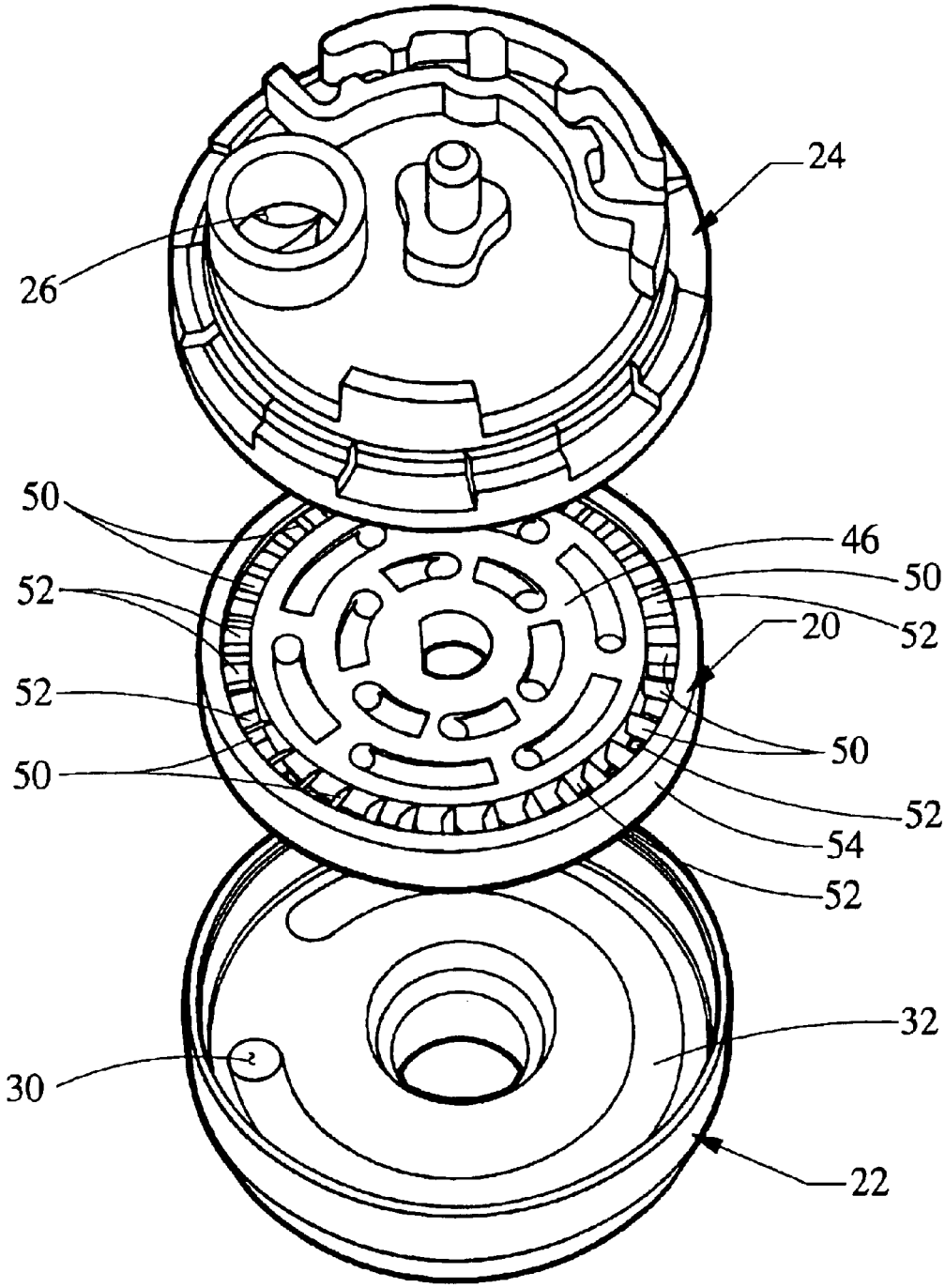
FIG. 2 is an exploded view of a pump body, pump cover, and impeller of the fuel pump shown in FIG. 1.

Referring to FIG. 2, the impeller 20 has an impeller body 46 which is substantially disk shaped. The impeller body 46 includes a plurality of vanes 50 extending radially outward from an outer circumference of the impeller 20. The impeller 20 includes a plurality of partitions positioned between each adjacent pair of vanes 50 which extend outward from the outer circumference of the impeller body 46 a shorter radial distance than the vanes 50. The partitions and the vanes 50 define a plurality of vane grooves 52. Each of the vanes 50 extend radially outward from the impeller body 46 to a distal end. A ring portion 54 is fitted around and attached to the distal ends of the vanes 50. The vanes 50, the vane grooves 52 and the ring portion 54 define a plurality of extending fuel flow passages extending across the impeller 20.

Preferably, the vanes 50 are un-evenly spaced around the outer circumference of the impeller 20. In other words, the distance between any two adjacent vanes 50 is not a constant, and varies in a non-repeating pattern about the circumference of the impeller 20. By spacing the vanes 50 un-evenly, harmonic pulsations are reduced within the impeller 20. Also, the pattern of the spacing of the vanes 50 is a non-repeating pattern to further reduce harmonic pulsations.

Figure 3:
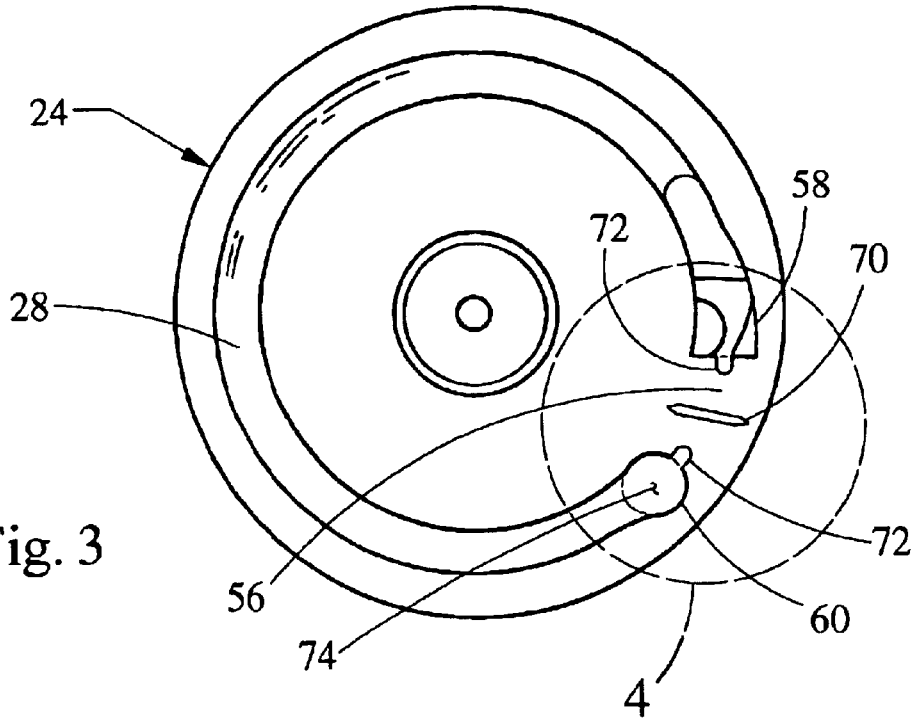
FIG. 3 is a top view of the pump cover.
Figure 4:
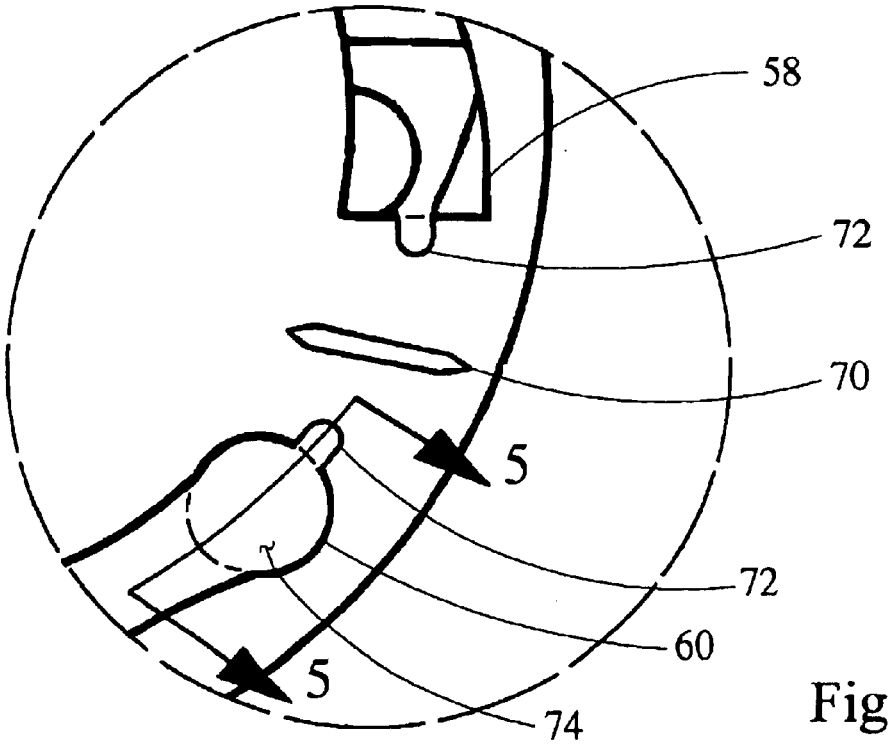
FIG. 4 is an enlarged view of a portion of FIG. 3 showing one straight radial groove.

Referring to FIGS. 3 and 4, the pump cover 24 includes a stripper area 56. The first flow channel 28 of the pump cover 24 includes an inlet end 58, and extends annularly from the inlet end 58 around the pump cover 24 to an outlet end 60. The fuel inlet orifice 26 is in fluid communication with the inlet end 58 of the first flow channel 28. The stripper area 56 is defined as the area between the inlet end 58 and the outlet end 60 of the first flow channel 28 extending annularly from the inlet end 58 away from the first flow channel 28 to the outlet end 60.

Figure 6:
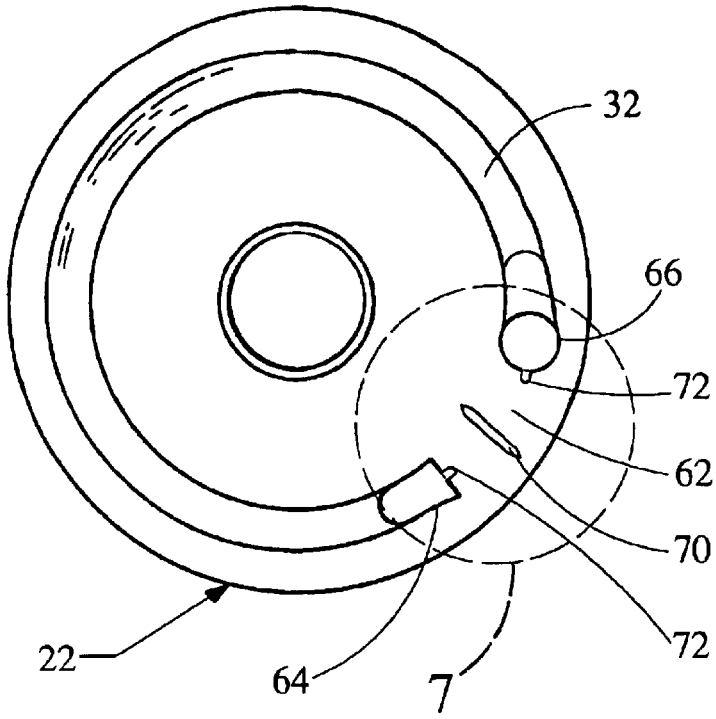
FIG. 6 is a top view of the pump body.
Figure 7:
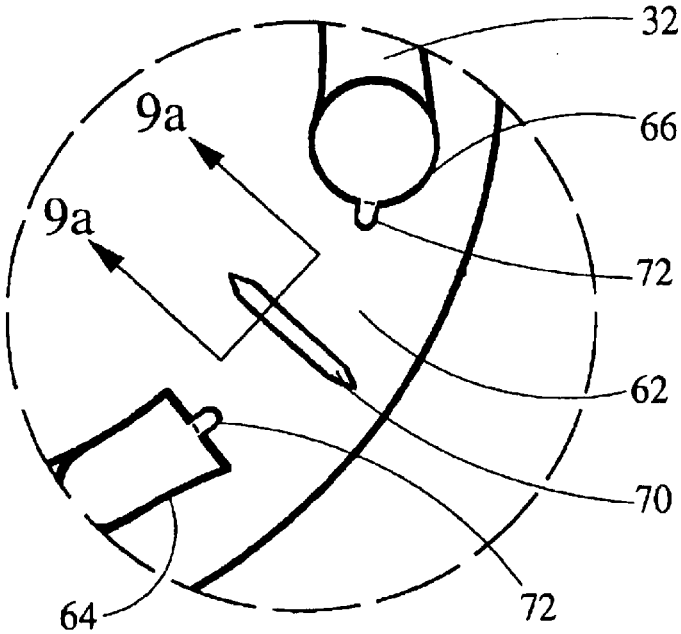
FIG. 7 is an enlarged view of a portion of FIG. 4 showing one straight radial groove.

Referring to FIGS. 6 and 7, the pump body 22 also includes a stripper area 62. The second flow channel 32 of the pump body 22 includes an inlet end 64, and extends annularly from the inlet end 64 around the pump body 22 to an outlet end 66, and to the fuel outlet orifice 30. The stripper area 62 is defined as the area between the inlet end 64 of the second flow channel 32 and the outlet end 66 extending annularly from the inlet end 64 of the second flow channel 32 away from the second flow channel 32 to the outlet end 66.

Preferably, the stripper areas 56, 62 of both the pump cover 24 and the pump body 22 have at least one radially extending groove 70 formed therein. The stripper areas 56, 62 can have one radial groove 70, as shown in FIGS. 3, 4, 6, and 7, or alternatively, the stripper areas 56, 62 can include more than one radial groove 70, as shown in FIG. 8, where the stripper area has three radial grooves 70.

Preferably, if more than one radial groove 70 is present, the radial grooves 70 within either of the stripper areas 56, 62 are spaced apart from one another a distance that is not less than the distance between any two adjacent vanes 50 of the impeller 20. This way, no one vane groove 52 can simultaneously be in fluid communication with more than one of the radial grooves 70. This will prevent leakage between the vane grooves 52 as the vane grooves 52 move over the radial grooves 70.

Figure 8:
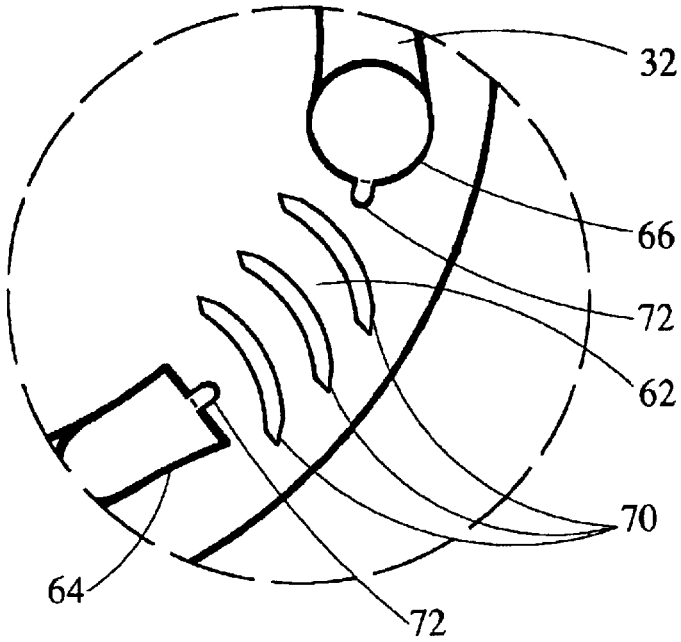
FIG. 8 is a view similar to FIG. 6 showing three curved radial grooves.

The radial grooves 70 can be straight, as shown in FIGS. 3, 4, 6, and 7, or curved, as shown in FIG. 8. It would be preferable to have curved or bent radial grooves 70 if the vanes 50 of the impeller 20 were curved. The radial grooves 70 formed within the stripper areas 56, 62 of the pump cover 24 and the pump body 22 provide a volume expansion to the vane grooves 52 as the vanes 50 move over the radial grooves 70. This volume expansion provides dampening to reduce the pressure pulsations within the pumping chamber of the fuel pump 10.

Figure 9A:
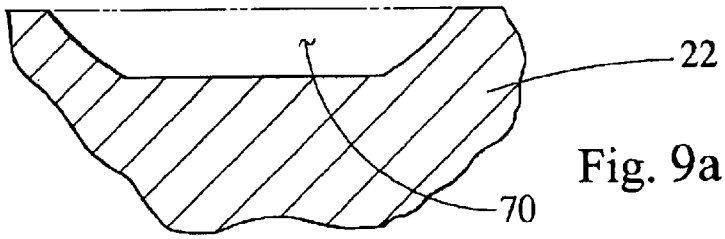
FIG. 9*a* is a cross sectional view of a flat bottomed radial groove.
Figure 9B:
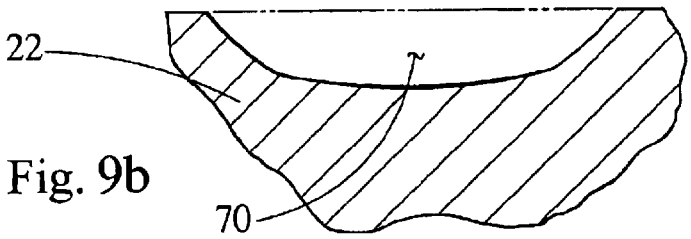
FIG. 9*b* is a cross sectional view of an ellipitical bottomed radial groove.
Figure 9C:
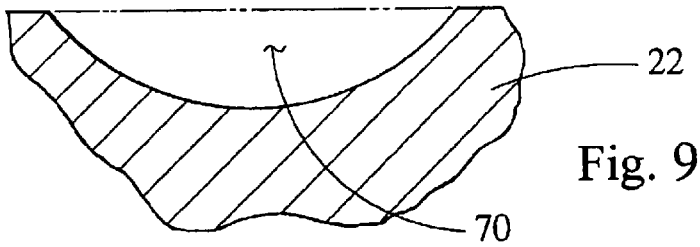
FIG. 9*c* is a cross sectional view of a circular radial groove.

Referring to FIGS. 9*a,* 9*b,* and 9*c,* the radial grooves 70 formed within the stripper areas 56, 62 of the pump cover 24 and the pump body 22 can have different cross sectional shapes. The shape of the radial grooves 70 can be flat bottomed, as shown in FIG. 9*a,* elliptical bottomed, as shown in FIG. 9*b,* or circular, as shown in FIG. 9*c*. It is to be understood, that the cross sectional shape of the radial grooves 70 is determined by characteristics of the fuel pump 10, and any appropriate cross sectional shape could be utilized.

Referring again to FIGS. 3, 4, 6, and 7, a second prererred embodiment further includes a groove tail 72 extending into the stripper areas 56, 62 from either the inlet ends 58, 64 or the outlet ends 60, 66 of the first and second flow channels 28, 32. As shown, both ends of the flow channels 28, 32 can have a groove tail 72, or alternatively, only one end of either of the flow channels 28, 32 includes a groove tail 72. Similarly to the radial grooves 70, the groove tails 72 will provide a volume expansion which will reduce the pressure pulsations within the pumping chamber.

Figure 5:
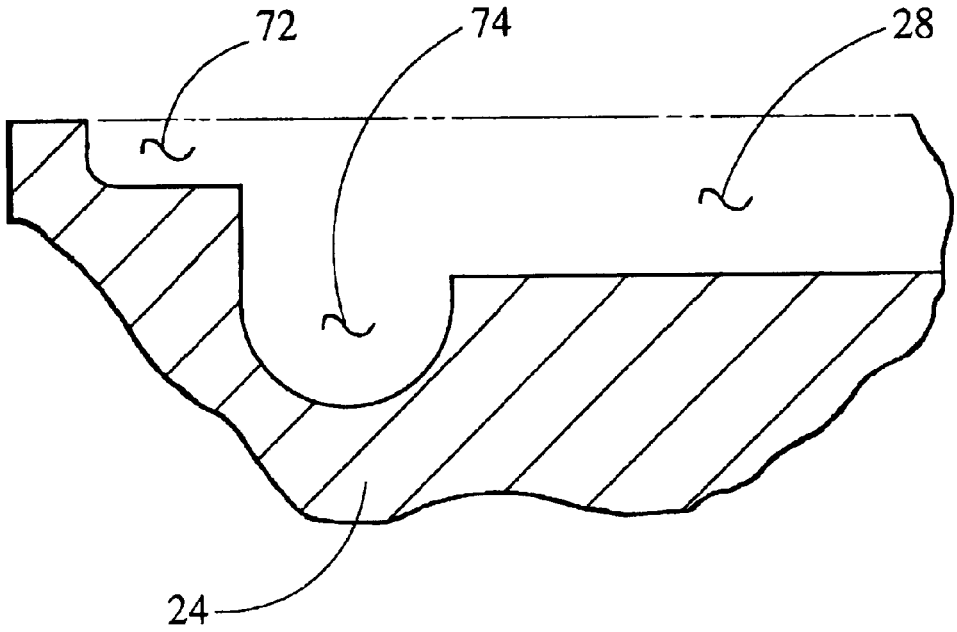
FIG. 5 is a side sectional view taken along line 5—5 in FIG. 4.

Referring to FIGS. 3, 4 and 5, in a third preferred embodiment, the first flow channel 28 formed within the pump cover 22 includes a pocket 74 formed adjacent the outlet end 60. Preferably, the pocket 74 is deeper than the first flow channel 28. Because the pressure of the fuel at the outlet end 60, 66 of the flow channels 28, 32 is greater than the pressure of the fuel near the inlet end 58, 64 of the flow channels 28, 32, the pocket 74 at the outlet end 60 of the first flow channel 28 will provide a reservoir of fuel to allow volume expansion and to reduce the pressure pulsations within the pumping chamber as the fuel pump 10 operates. FIG. 5 illustrates the relative depth profile of the groove tail 72, the flow channel 28, and the pocket 74.

The foregoing discussion discloses and describes three preferred embodiments of the invention. One skilled in the art will readily recognize from such discussion, and from the accompanying drawings and claims, that changes and modifications can be made to the invention without departing from the scope of the invention as defined in the following claims. The invention has been described in an illustrative manner, and it is to be understood that the terminology which has been used is intended to be in the nature of words of description rather than of limitation.

We claim:

1. A regenerative fuel pump comprising:

a housing;

a pump cover mounted within said housing, said pump cover having a first side having a fuel inlet orifice and a second side defining a sealing surface and having a first flow channel formed therein, said fuel inlet orifice extending through said cover in fluid communication with said first flow channel;

a pump body mounted within said housing adjacent said pump cover, said pump body having a first side having an outlet orifice and a second second flow channel formed therein whereby said first flow channel and said second flow channel define a pumping chamber, said outlet orifice extending through pump body in fluid communication with said second flow channel;

an impeller mounted between said pump cover and said pump body within said pumping chamber, said impeller including a plurality of radially outwardly extending vanes spaced circumferentially about said impeller and defining a plurality of vane grooves, said vanes being spaced un-evenly in a non-repeating pattern about said impeller;

said first flow channel having an inlet end and an outlet end and extending radially around said pump cover between said inlet end and said outlet end, said pump cover having a first stripper area defined as the area between said inlet end and said outlet end extending from said inlet end away from said first flow channel, said fuel inlet orifice being in fluid communication with said inlet end of said first flow chanel;

said second flow channel having an inlet end and an outlet end and extending radially around said pump body between said inlet end and said outlet end, said pump body having a second stripper area defined as the area between said inlet end and said outlet end extending from said inlet end away from said second flow channel, said outlet orifice being in fluid communication with said outlet end of said second flow channel;

at least one of said first and second stripper areas having a plurality of grooves formed therein and adapted to dampen pressure pulsations within said pumping chamber, said plurality of grooves comprising at least one radially extending groove formed therein, said radially extending groove not connecting to said first and second flow channels, and a groove tail extending from each of said inlet end and said outlet end of said first flow channel and a groove tail extending from each of said inlet end and said outlet end of said second flow channel.

2. The regenerative fuel pump of claim 1 wherein said radially extending grooves are straight.

3. The regenerative fuel pump of claim 1 wherein said radially extending grooves are curved.

4. The regenerative fuel pump of claim 1 wherein said radially extending grooves have a cross sectional profile that is one of flat bottomed, elliptical bottomed, and circular.

5. The regenerative fuel pump of claim 1 wherein said first flow channel within said pump cover includes a pocket formed adjacent said outlet end.

6. The regenerative fuel pump of claim 5 wherein said pocket has a depth that is greater that said first flow channel.

7. A regenerative fuel pump comprising:

a housing;

a pump cover mounted within said housing, said pump cover having a first side having a fuel inlet orifice and a second side defining a sealing surface and having a first flow channel formed therein, said fuel inlet orifice extending through said cover in fluid communication with said first flow channel;

a pump body mounted within said housing adjacent said pump cover, said pump body having a first side having an outlet orifice and a second side having a second flow channel formed therein whereby said first flow channel and said second flow channel define a pumping chamber, said outlet orifice extending through said pump body in fluid communication with said second flow channel;

an impeller mounted between said pump cover and said pump body within said pumping chamber, said impeller including a plurality of radially outwardly extending vanes spaced circumferentially about said impeller and defining a plurality of vane grooves, said vanes being spaced un-evenly in a non-repeating pattern about said impeller;

said first flow channel having an inlet end and an outlet end and extending radially around said pump cover between said inlet end and said outlet end, said pump cover having a first stripper area defined as the area between said inlet end and said outlet end extending from said inlet end away from said first flow channel, said fuel inlet orifice being in fluid communication with said inlet end of said first flow channel;

said second flow channel having an inlet end and an outlet end and extending radially around said pump body between said inlet end and said outlet end, said pump body having a second stripper area defined as the area between said inlet end and said outlet end extending from said inlet end away from said second flow channel, said outlet orifice being in fluid communication with said outlet end of said second flow channel;

wherein said stripper area of said pump body includes at least two radially extending grooves formed therein to dampen pressure pulsations within said pumping chamber, said radially extending grooves of said pump cover not connecting to said first flow channel and being spaced apart from one another a distance not less than the distance between any two adjacent vanes such that none of said vane grooves can simultaneously be in fluid communication with more than one of said radially extending grooves.

8. The regenerative fuel pump of claim 7 wherein said plurality of grooves comprises a groove tail extending from one of said inlet end and said outlet end of said first flow channel and a groove tail extending from one of said inlet end and said outlet end of said second flow channel.

9. The regenerative fuel pump of claim 8 wherein said first flow channel within said pump cover includes a pocket formed adjacent said outlet end.

10. The regenerative fuel pump of claim 9 wherein said pocket has a depth that is greater than said first flow channel.

11. The regenerative fuel pump of claim 7 wherein said radially extending grooves are straight.

12. The regenerative fuel pump of claim 7 wherein said radially extending grooves are curved.

13. The regenerative fuel pump of claim 7 wherein said radially extending grooves have a cross sectional profile that is one of flat bottomed, elliptical bottomed, and circular.

14. A regenerative fuel pump comprising:

a housing;

a pump cover mounted within said housing, said pump cover having a first side having a fuel inlet orifice and a second side defining a sealing surface and having a first flow channel formed therein, said fuel inlet orifice extending through said cover in fluid communication with said first flow channel;

a pump body mounted within said housing adjacent said pump cover, said pump body having a first side having an outlet orifice and a second side having a second flow channel formed therein whereby said first flow channel and said second flow channel define a pumping chamber, said outlet orifice extending through said pump body in fluid communication with said second flow channel;

an impeller mounted between said pump cover and said pump body within said pumping chamber, said impeller including a plurality of radially outwardly extending vanes spaced circumferentially about said impeller and defining a plurality of vane grooves, said vanes being spaced un-evenly in a non-repeating pattern about said impeller;

said first flow channel having an inlet end and an outlet end and extending radially around said pump cover between said inlet end and said outlet end, said pump cover having a first stripper area defined as the area between said inlet end and said outlet end extending from said inlet end away from said first flow channel, said fuel inlet orifice being in fluid communication with said inlet end of said first flow channel;

said second flow channel having an inlet end and an outlet end and extending radially around said pump body between said inlet end and said outlet end, said pump body having a second stripper area defined as the area between said inlet end and said outlet end extending from said inlet end away from said second flow channel, said outlet orifice being in fluid communication with said outlet end of said second flow channel;

wherein said stripper area of said pump body includes at least two radially extending grooves formed therein to dampen pressure pulsations within said pumping chamber, said radially extending grooves of said pump body not connecting to said second flow channel and being spaced apart from one another a distance not less than the distance between any two adjacent vanes such that none of said vane grooves can simultaneously be in fluid communication with more than one of said radially extending grooves.

15. The regenerative fuel pump of claim 14 wherein said plurality of grooves comprises a grove tail extending from one of said inlet end and said outlet end of said first flow channel and a groove tail extending from one of said inlet end and said outlet end of said second flow channel.

16. The regenerative fuel pump of claim 15 wherein said first flow channel within said pump cover includes a pocket formed adjacent said outlet end.

17. The regenerative fuel pump of claim 16 wherein said pocket has a depth that is greater than said first flow channel.

18. The regenerative fuel pump of claim 14 wherein said radially extending grooves are straight.

19. The regenerative fuel pump of claim 14 wherein said radially extending grooves are curved.

20. The regenerative fuel pump of claim 14 wherein said radially extending grooves have a cross sectional profile that is one of flat bottomed, elliptical bottomed, and circular.

21. A regenerative fuel pump comprising:

a housing;

a pump cover mounted within said housing, said pump cover having a first side having a fuel inlet orifice and a second side defining a sealing surface and having a first flow channel formed therein, said fuel inlet orifice extending through said cover in fluid communication with said first flow channel;

a pump body mounted within said housing adjacent said pump cover, said pump body having a first side having an outlet orifice and a second side having a second flow channel formed therein whereby said first flow channel and said second flow channel define a pumping chamber, said outlet orifice extending through said pump body in fluid communication with said second flow channel;

an impeller mounted between said pump cover and said pump body within said pumping chamber, said impeller including a plurality of radially outwardly extending vanes spaced circumferentially about said impeller and defining a plurality of vane grooves, said vanes being spaced un-evenly in a non-repeating pattern about said impeller;

said first flow channel having an inlet end and an outlet end and extending radially around said pump cover between said inlet end and said outlet end, said pump cover having a first stripper area defined as the area between said inlet end and said outlet end extending from said inlet end away from said first flow channel, said fuel inlet orifice being in fluid communication with said inlet end of said first flow channel;

said second flow channel having an inlet end and an outlet end and extending radially around said pump body between said inlet end and said outlet end, said pump body having a second stripper area defined as the area between said inlet end and said outlet end extending from said inlet end away from said second flow channel, said outlet orifice being in fluid communication with said outlet end of said second flow channel;

at least one of said first and second stripper areas having a plurality of grooves formed therein and adapted to dampen pressure pulsations within said pumping chamber, said plurality of grooves comprising a groove tail extending from each of said inlet end and said outlet end of said first flow channel and a groove tail extending from each of said inlet end and said outlet end of said second flow channel.

22. The regenerative fuel pump of claim 21 wherein said first flow channel within said pump cover includes a pocket formed adjacent said outlet end.

23. The regenerative fuel pump of claim 22 wherein said pocket has a depth that is greater than said first flow channel.

* * * * *